US008037805B1

(12) United States Patent
Neroni

(10) Patent No.: US 8,037,805 B1
(45) Date of Patent: Oct. 18, 2011

(54) PISTOL WITH OFF-AXIS SLIDE

(76) Inventor: Randy A. Neroni, Sterling Heights, MI (US)

( * ) Notice: Subject to any disclaimer, the term of this patent is extended or adjusted under 35 U.S.C. 154(b) by 335 days.

(21) Appl. No.: 12/323,865

(22) Filed: Nov. 26, 2008

Related U.S. Application Data

(60) Provisional application No. 61/005,151, filed on Dec. 3, 2007.

(51) Int. Cl.
*F41A 9/23* (2006.01)

(52) U.S. Cl. ..... 89/196

(58) Field of Classification Search ..... 89/196, 89/194, 195; 42/111, 113, 122, 14, 38, 40, 42/1.06, 134, 6, 7
See application file for complete search history.

(56) References Cited

U.S. PATENT DOCUMENTS

| | | | | |
|---|---|---|---|---|
| 2,308,629 | A * | 1/1943 | Rosenberg | 211/131.1 |
| 3,492,748 | A | 2/1970 | Swenson | 42/70 |
| 3,815,270 | A | 6/1974 | Pachmayr | 42/71.02 |
| 3,983,654 | A | 10/1976 | Vironda | 42/69 R |
| 4,043,066 | A | 8/1977 | Pachmayr et al. | 42/71.02 |
| 4,048,901 | A | 9/1977 | Ghisoni | 89/132 |
| 4,651,456 | A | 3/1987 | Ghisoni | 42/62 |
| 4,754,689 | A | 7/1988 | Grehl | 89/196 |
| 4,835,892 | A * | 6/1989 | Ruger et al. | 42/7 |
| 5,426,880 | A | 6/1995 | Ruger | 42/69.03 |
| 5,924,230 | A | 7/1999 | Hoke, Jr. | 42/60 |
| 6,112,636 | A * | 9/2000 | Besselink | 89/191.01 |
| 6,257,116 | B1 | 7/2001 | Moczijdlower et al. | 89/155 |
| 6,360,471 | B1 * | 3/2002 | Stein | 42/122 |
| D517,638 | S | 3/2006 | Bilgeri | D22/108 |

* cited by examiner

*Primary Examiner* — Bret Hayes
*Assistant Examiner* — Reginald Tillman, Jr.
(74) *Attorney, Agent, or Firm* — Christopher P. Maiorana, PC

(57) ABSTRACT

An apparatus having a frame, a slide assembly and a barrel is disclosed. The slide assembly may be slidably mounted to the frame along a sliding plane. The barrel may be disposed in the slide assembly. The barrel generally has a bore shaped to accept an ammunition round. The bore may define a bore axis intersecting the sliding plane such that when the ammunition round is fired the slide assembly recoils both backward and upward relative to the frame.

20 Claims, 22 Drawing Sheets

PISTOL WITH OFF-AXIS SLIDE

This application claims the benefit of U.S. Provisional Application No. 61/005,151, filed Dec. 3, 2007, which is hereby incorporated by reference in its entirety.

FIELD OF THE INVENTION

The present invention relates to pistols generally and, more particularly, to a method and/or apparatus for implementing a pistol with an off-axis slide.

BACKGROUND OF THE INVENTION

Conventional pistols have a barrel locked to a slide that accommodates a recoil when the gun is fired. The slide is typically aligned parallel to an axis of the barrel. During recoil, the movement of the slide causes the pistol to rotate muzzle-upward in the hands of the shooter. A mechanism to minimize the rotation is desirable.

SUMMARY OF THE INVENTION

The present invention generally concerns an apparatus comprising a frame, a slide assembly and a barrel. The slide assembly may be slidably mounted to the frame along a sliding plane. The barrel may be disposed in the slide assembly. The barrel generally has a bore shaped to accept an ammunition round. The bore may define a bore axis intersecting the sliding plane such that when the ammunition round is fired the slide assembly recoils both backward and upward relative to the frame.

The objects, features and advantages of the present invention include providing a method and/or apparatus for implementing a pistol with an off-axis slide that may (i) minimize "overburden" recoil during firing, (ii) relocate a barrel bore lower in relation to the user's thumb than in conventional designs, (iii) provide sear-less operation, (iv) provide an aligned-triangle sight, (v) provide click-adjustable windage and elevation control, (vi) have an ambidextrous magazine release and/or (vii) be completely field strippable without special tools.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Embodiments of the present invention generally concern a semiautomatic pistol with lower barrel/center of gravity multifunction parts. Field stripping and grip removal may be accomplished without special tools due to a lack of threaded fasteners. Click adjustable, snag-less field replaceable sights may be included for aiming. The sights generally appear as an opposed triangle-diamond shape sight picture. Various embodiments may include some or all of an adjustable trigger, an ambidextrous magazine release and safeties, a grip with retainers, a sear-less fire control system and a single-piece safety/slide stop detent spring.

Figure 1:
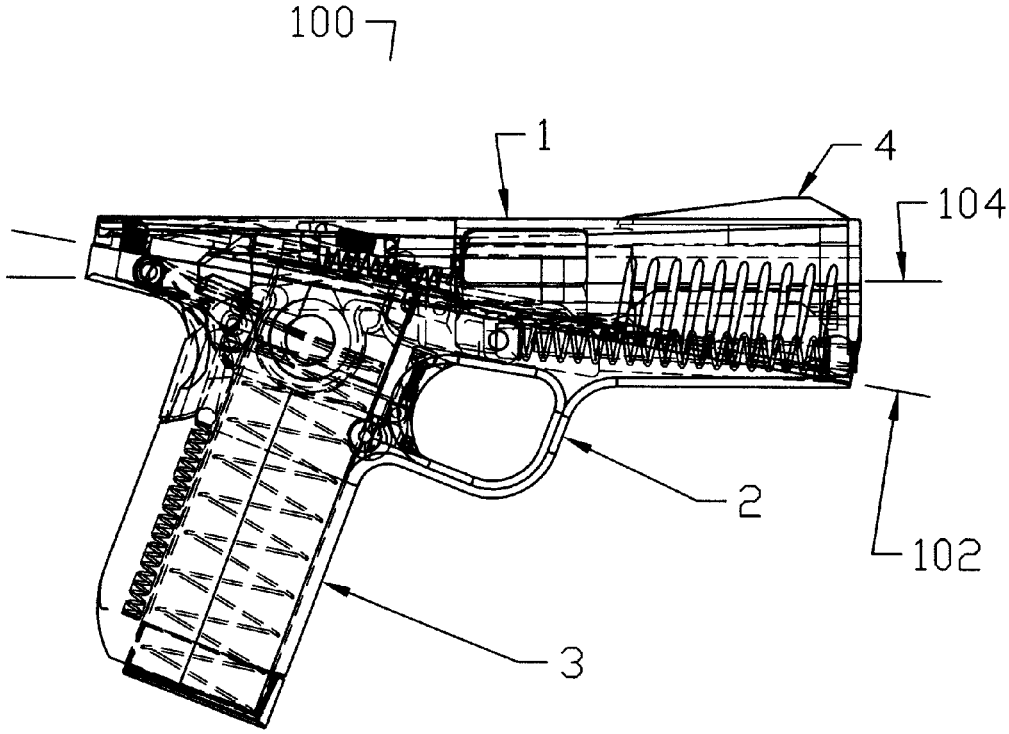
FIG. 1 is a see-through diagram of an apparatus.

Referring to FIG. 1, a see-through diagram of an apparatus 100 is shown in accordance with a preferred embodiment of the present invention. The apparatus (or device) 100 may be referred to as a handgun, a semiautomatic pistol and/or a pistol. The pistol 100 generally comprises a slide (or assembly) 1, a frame (or assembly) 2, a grip (or assembly) 3, a front sight (or assembly) 4, a rear sight tail (or assembly) 6 (see FIG. 5), and a barrel (or assembly) 16. The slide 1 may be slidably mounted to the frame 2 along a sliding plane (or axis) 102. The barrel 16 may have a bore that defines a bore axis 104. A bullet (e.g., 9 mm Luger caliber ammunition, .45 Automatic Colt Pistol ammunition or the like) fired through the barrel 16 generally travels along the bore axis 104.

The bore axis 104 may define a longitudinal axis of the pistol 100. A lateral axis of the pistol 100 may run normal to both the bore axis 104 and a vertical axis. The sliding plane 102 may be nonparallel to the bore axis 104 to minimize pitch rotation during firing. Furthermore, the bore axis 104 may be located above the sliding plane 102 at a muzzle end of the pistol 100, intersect the sliding plane 102 slightly behind a trigger, and be located below said sliding plane 102 at a tail end of the pistol 100. An angle formed between the slide plane 102 and the bore axis 104 may range from approximately 5 degrees to approximately 15 degrees.

Referring to FIGS. 2-5 and 23, partial diagrams of the pistol 100 are shown. The pistol 100 generally includes a mating surface (or assembly) 1*a* of the slide 1, a cam track (or assembly) 2*a* and one or more circular holes 2*b* in the frame 2, the front sight 4, a rear sight base (or assembly) 5, the rear sight tail 6, a rear sight insert (or assembly) 7, a right-hand adjustable screw (or assembly) 8, a left-hand adjustable screw (or assembly) 9, a firing pin (or assembly) 10, a firing pin return spring (or assembly) 11, an extractor (or assembly) 12, an extractor spring (or assembly) 13, a rear sight plunger (or assembly) 14, an extractor plunger (or assembly) 15, two opposed lugs (or assemblies) 16*a* (one visible), a control lug (or assembly) 16*b*, a barrel bushing (or assembly) 17, a recoil buffer (or assembly) 18, a rod guide (or assembly) 19 having a guide rod base 19*a*, a guide rod ball (or assembly) 20, a guide rod spring (or assembly) 21, a slide stop (or assembly) 22 having a slide stop pin 22*b*, a transfer bar (or assembly) 23, a hammer strut (or assembly) 26, a hammer spring (or assembly) 28, a trigger (or assembly) 30, a trigger pin (or assembly) 31, a trigger return plunger (or assembly) 32, a grip safety (or assembly) 40 a trigger return/grip safety spring (or assembly)

41, a right-hand safety lever (or assembly) 42, a magazine tube (or assembly) 45 and a magazine base (or assembly) 47.

Action of the pistol 100 generally works on a short recoil operating principle. At a start of the action, the barrel 16 may be locked to the slide 1. The locking may be achieved by the two opposed (locking) lugs 16*a* on the barrel 16 that contact the mating surfaces 1*a* of the slide 1. Locking and unlocking is generally controlled by a control lug 16*b*. The control lug 16*b* generally extends from the barrel 16 and follows the cam track 2*a* in the frame 2. The control lug 16*b* and the cam track 2*a* may be proportioned to control a recoil, a dwell, an unlock distance and a lock distance as specified for the pressure characteristics of a type of cartridge (ammunition or round) for which the pistol 100 is chambered.

Figure 5:
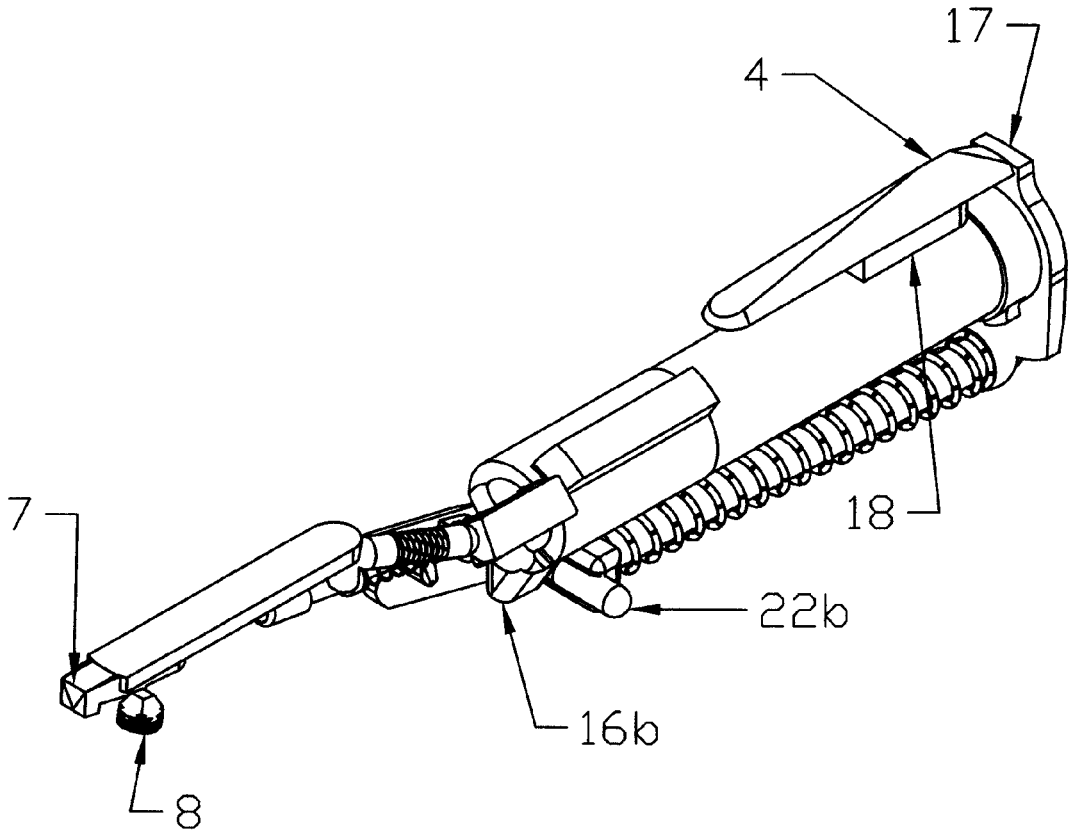
FIG. 5 is a perspective-view diagram of a sight mechanism.

Upon firing a round of ammunition, the slide 1 and the barrel 16 generally recoil to the rear of the pistol 100 as a unit for a set distance (e.g., the dwell distance). During the recoil, the control lug 16*b* may contact an angled surface of the cam track 2*a* in the frame 2 causing the barrel 16 to rotate and unlock from the slide 1 (e.g., an "unlock section" of the cam track 2*a*). With the barrel 16 unlocked from the slide 1, the barrel 16 may be held in the longitudinal direction (e.g., front to back) as the slide 1 continues to recoil to the rear. Although held longitudinally, the barrel 16 (and the corresponding bore axis) generally continue to move away from the frame 2 in the vertical direction. The upward movement may be due to the slide 1 being mounted to the frame 2 on the sliding axis 102 at an angle. The upward movement of the barrel 16 generally continues until the slide 1 has reached a rearward travel limit. At the rearward travel limit, the recoil buffer 18 may be caught between the slide 1 and the opposed lugs 16*a* (or upper lug). The recoil buffer 18 and the front sight 4 may be formed as a single piece and each may preform a respective function as if separate pieces. The front sight 4 may be held in a longitudinal dovetail by the barrel bushing 17. FIG. 5 generally shows how the barrel bushing 17 blocks forward motion of the front sight 4 from the dovetail in the slide 1. The barrel 16 is generally held in position longitudinally because the projection length of the control lug 16*b* may be sufficient to remain in contact with the cam track 2*a* in the frame 2 throughout the entire firing, recoil extraction, ejection and feeding cycle.

Figure 6:
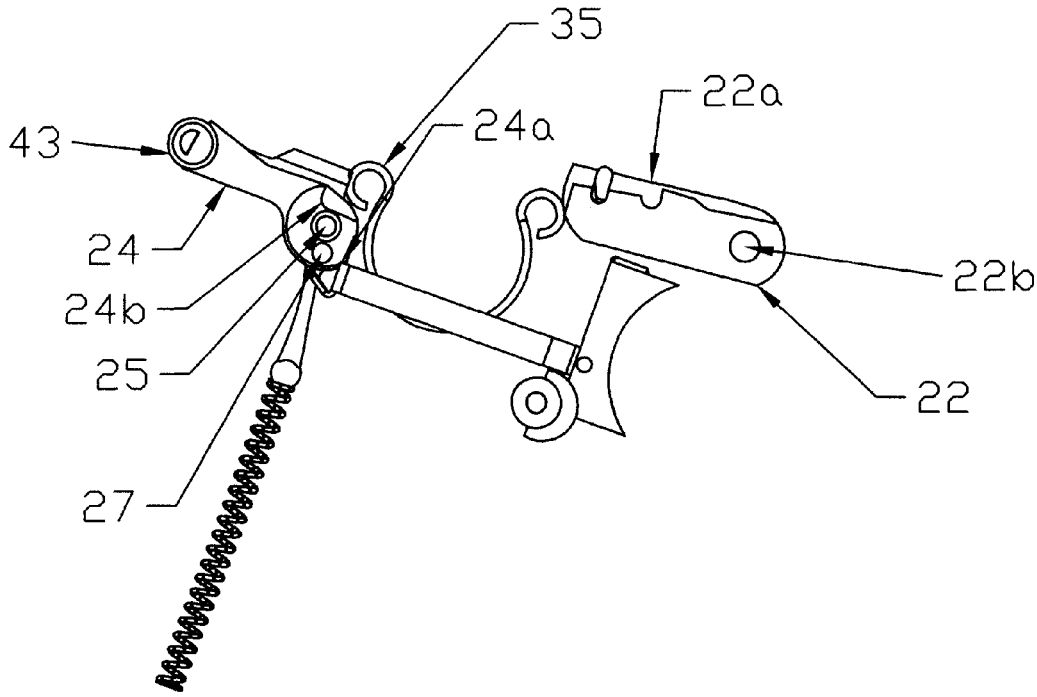
FIG. 6 is a partial diagram of a fire control mechanism.
Figure 7:
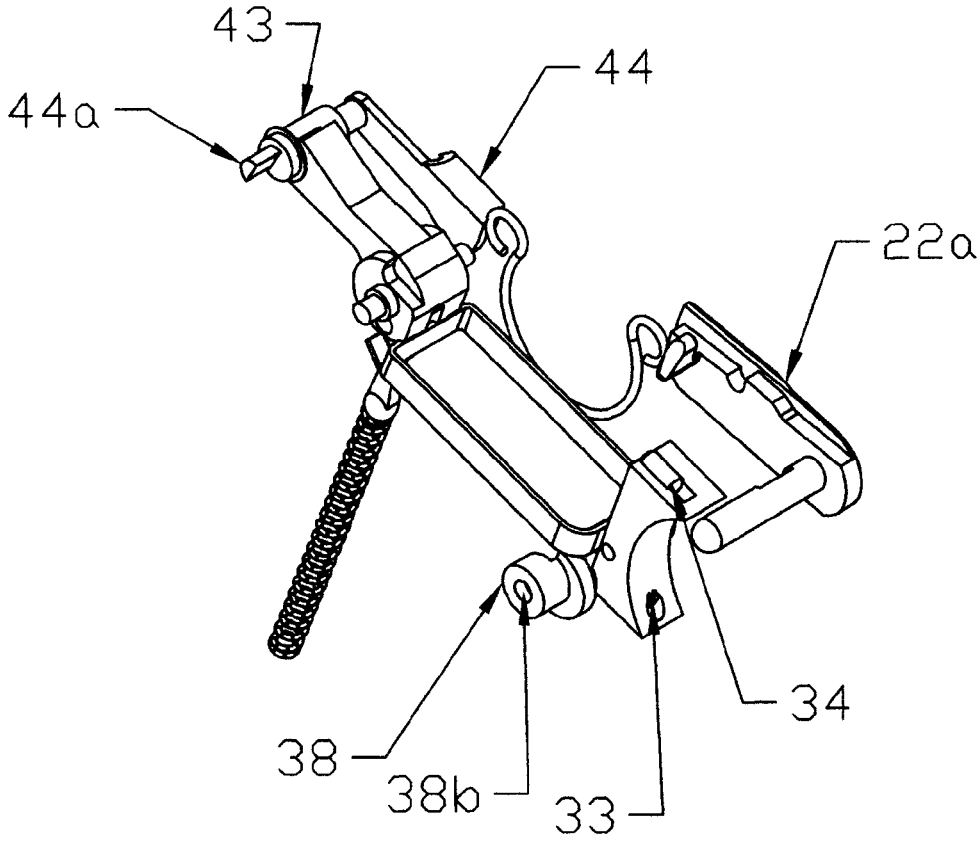
FIG. 7 is a partial diagram of the fire control mechanism.
Figure 8:
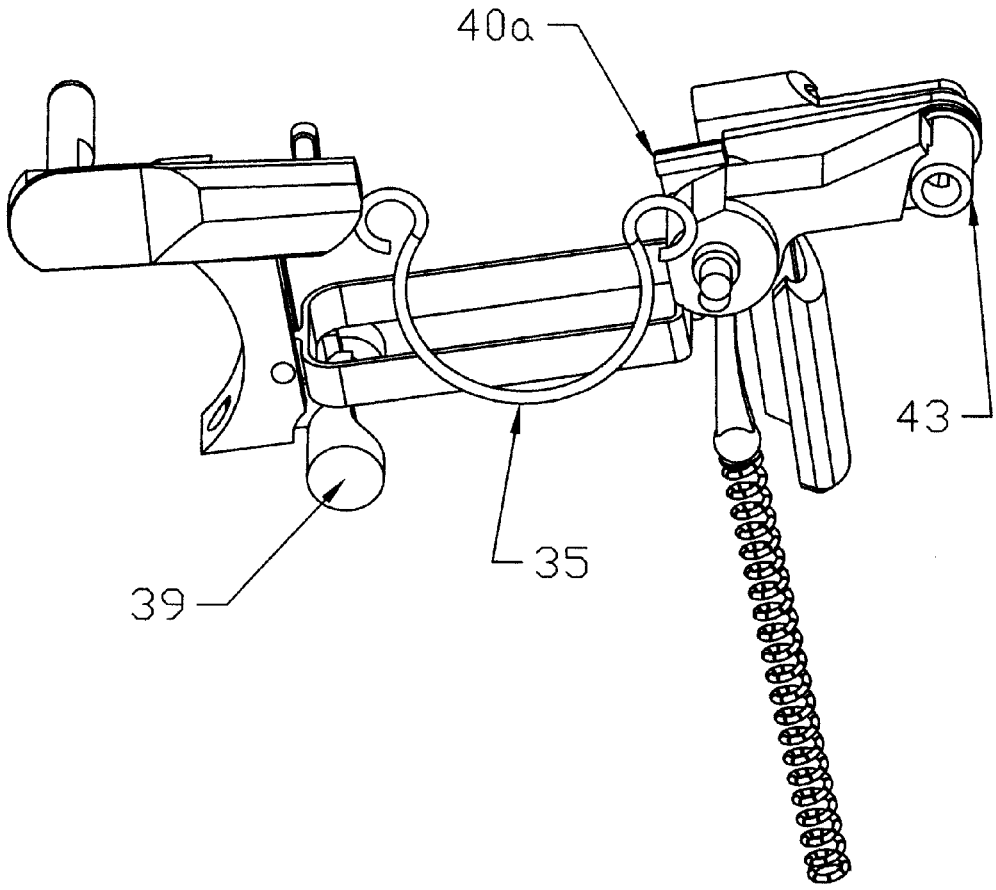
FIG. 8 is a partial diagram of the fire control mechanism.
Figure 9:
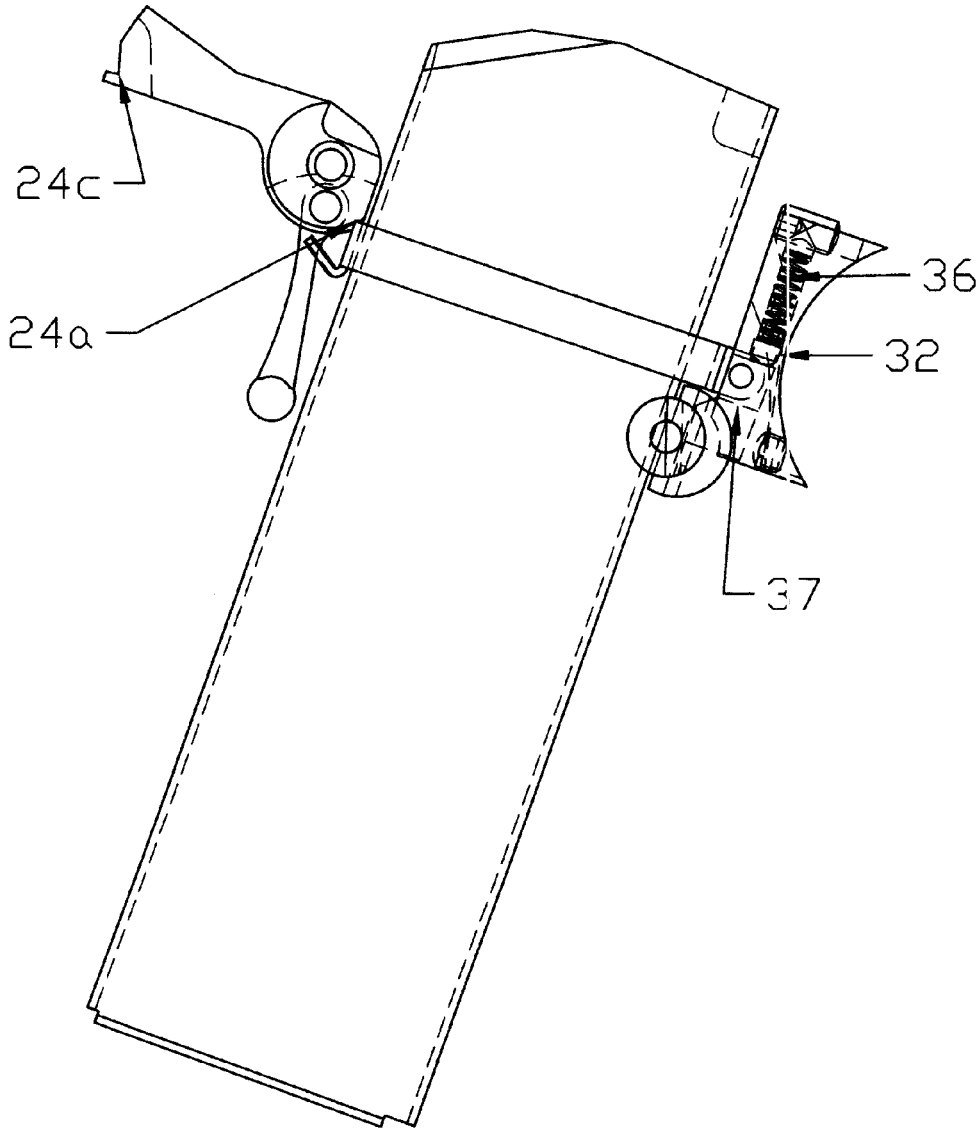
FIG. 9 is a partial diagram of the fire control mechanism.

A force suitable to (i) retard the recoil of the slide 1, (ii) return the slide 1 to a battery position and (iii) hold the slide 1 in the battery position is generally provided by a guide rod spring 21. The guide rod spring 21 may be interposed between the slide 1 and the frame 2 below and aligned with the barrel 16. The guide rod spring 21 is generally guided and stabilized by a guide rod 19 that passes through a length of the guide rod spring 21. A rear end of the guide rod 19 may be attached to the frame 2 by a slide stop pin 22*b* (FIG. 6) on a slide stop lever 22*a* (FIG. 6). The slide stop pin 22*b* generally passes laterally through both the frame 2 and the guide rod base 19*a*. The guide rod spring 21 may apply a forward force to the slide 1 via the guide rod ball 20. The guide rod ball 20 may have a bore that the guide rod 19 passes through. The guide rod ball 20 generally nests in a ball-shaped recess in the slide 1 and/or the barrel bushing 17. The above spring-guide rod arrangement may allow full control of the guide rod spring 21 as an angular condition of the guide rod spring 21 changes relative to slide 1, gripe frame 2 and barrel 16 throughout the firing cycle of the pistol 100.

Figure 2:
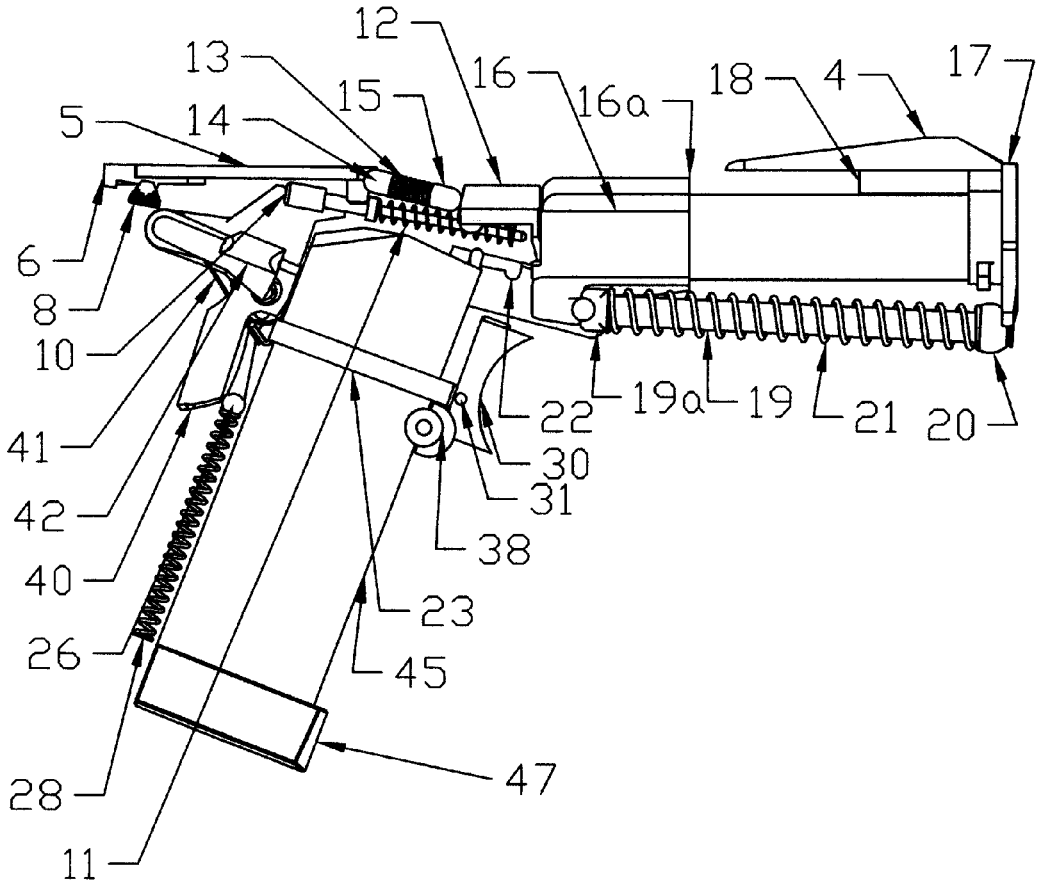
FIG. 2 is a partial diagram of the apparatus.
Figure 3:
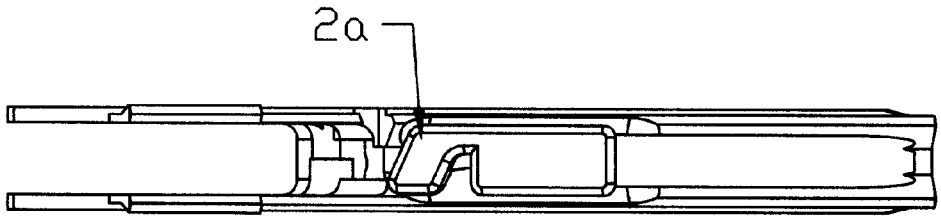
FIG. 3 is a top-view diagram of a frame.
Figure 10:
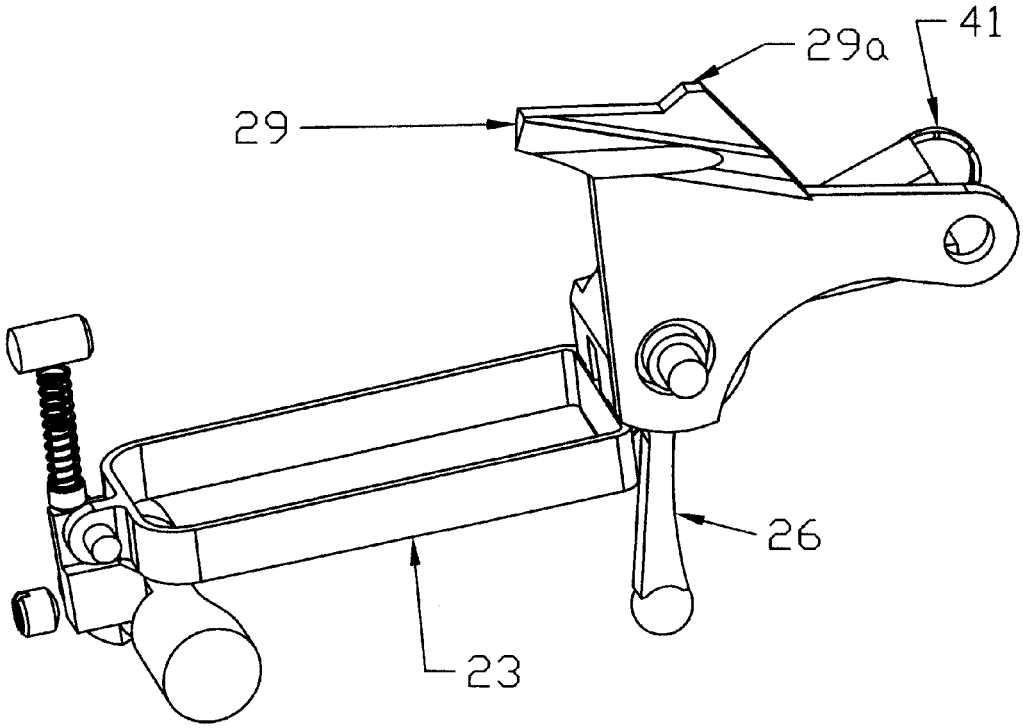
FIG. 10 is a partial diagram of the fire control mechanism.

Referring to FIGS. 2, 6 and 10, partial diagrams of a fire control mechanism portion of the pistol 100 are shown. The first control mechanism generally includes the slide stop 22 having a slide stop lever (or assembly) 22*a* and the slide stop pin 22*b*, a hammer (or assembly) 24 having a transfer bar notch (or assembly) 24*a* and a grip safety notch (or assembly) 24*b*, the hammer strut 26, the hammer spring 28, a disconnector/ejector (or assembly) 29, a projection (or assembly) 29*a*, a one-piece safety detent spring (or assembly) 35, the grip safety 40, the trigger return/grip safety spring 41, the right-hand safety lever 42, a safety dog (or assembly) 43 and a left-hand safety lever (or assembly) 44. The fire control mechanism may include a trigger assembly. The fire control mechanism generally includes the firing pin 10, the firing pin return spring 11, the transfer bar 23, the hammer 24, a hammer pin (or assembly) 25, a hammer strut pin (or assembly) 27, the hammer spring 28, the trigger 30, the trigger pin 31, a trigger over travel adjustment screw (or assembly) 33, a trigger return adjustment screw 34 (or assembly) and a trigger return lever (or plunger or assembly) 37.

The fire control mechanism generally functions as follows. The hammer 24 may be placed in a cocked position by the slide 1 as the slide 1 is moved rearward during recoil. Movement of the slide 1 forward may chamber a round of ammunition into the barrel 16. The slide 1 may cause the hammer 24 to be rotated counter clockwise (as viewed from the right of the pistol 100). The rotation of the hammer 24 generally compresses the hammer spring 28 until a particular point is reached in the rotation about the hammer pin 25 (e.g., over center) where a force of the hammer spring 28 takes over and continues to rotate the hammer 24 counter clockwise. At the particular point, the hammer strut 26 pivots, forcing the hammer 24 to the cocked position. No sear may exist in the fire control mechanism. The slide 1 may return to battery and the trigger return/grip safety spring 41 may (i) push the transfer bar 23 forward and upward and (ii) rotate the disconnector/ejector 29 (via the transfer bar 23) counter clockwise up (as viewed from the right side) to a fire position as long as the slide 1 is fully in battery. The transfer bar 23 may now be in contact with the transfer bar notch 24*a* on the hammer 24.

Referring to FIGS. 7-9 and 22, partial diagrams related to a firing cycle of the pistol 100 are shown. The pistol may include the slide step lever 22*a*, the transfer bar notch 24*a* and a notch 24*c* in the hammer 24, the trigger return plunger 32, the trigger over travel adjustment screw 33, the trigger return adjustment screw 34, a trigger return spring (or assembly) 36, the trigger return lever 37, the one-piece safety detent spring 35, a right-hand magazine release button (or assembly) 38 having a hole 38*b*, a left-hand magazine release button (or assembly) 39, a projection (or assembly) 40*a*, the right-hand safety lever 42, the safety dog 43, the left-hand safety lever 44, a safety lever pin (or assembly) 44*a*.

The shooter generally holds the grip 3 in a normal manner thereby causing the grip safety 40 to be pressed in by the web of the shooter's hand (not shown). The grip safety 40 generally rotates counter clockwise pivoting on a safety lever pin (or assembly) 42*a* of the right-hand safety lever 42, and the safety lever pin 44*a* thereby moving the projection 40*a* out of a notch 24*b* on the hammer 24. The shooter may press either the left-hand safety lever 44 or the right-hand safety lever 42 down. Movement of either safety lever 42 or 44 generally causes the safety dog 43, splined to the safety lever pins 42*a* and 44*a*, to disengage the notch 24*c* at the striking end of the hammer 24. The safety dog 43 disengaging the notch 24*c* generally permits rotation of the hammer 24 once the trigger 30 is pressed to the rear. Rotation of the hammer 24 may move the transfer bar 23 rearward, in turn rotating the hammer 24 clockwise via contact with the transfer bar notch 24*a*. Once the hammer 24 rotates to a point where the hammer strut pin 27 goes over center of the hammer pin 25, the hammer 24 generally rotates clockwise under spring power to strike the firing pin 10. Upon being struck, the firing pin 10 generally ignites the ammunition.

The recoil operation may be powered by the firing causing the hammer 24 to be reset to the cocked condition, as previously described. The disconnector/ejector 29 is generally pressed downward by the slide 1 coming into contact with a projection 29*a* on the disconnector/ejector 29 during the recoil operation. The contact with the slide 1 may rotate the disconnector/ejector 29 clockwise on the safety lever pin 42*a* causing a free end of the transfer bar 23 to be pressed down. The downward movement of the free end generally causes the transfer bar 23 to rotate counter clockwise on the trigger pin 31. The rotation between the transfer bar 23 and the trigger return/grip safety spring 41 may compress on the safety lever pins 42*a* and 44*a*. The above generally allows the hammer 24 to be cocked/re-cocked as previously described without the transfer bar notch 24*a* colliding with the transfer bar 23.

As the trigger 30 is pressed rearward, as previously described, the trigger return lever 37 may rotate on the trigger pin 31. The rotating the trigger return lever 37 generally compresses the trigger return spring 36 via the trigger return plunger 32 to store additional trigger return force. The trigger return adjustment screw 34 at the top may be used to adjust a return distance contacting a recess in the grip 3 or frame 2. Flats on the sides of the trigger return adjustment screw 34 generally nest against the trigger return spring 36 thus preventing unwanted incidental rotation of the trigger return adjustment screw 34. The trigger over travel adjustment screw 33 at the bottom of the trigger 30 may be used to set a rearward limit of the trigger 30. The trigger over travel adjustment screw 33 may limit an amount of rotation allowed to the trigger return lever 37 before the trigger return lever 37 is contacted (i) to the rear by the left-hand magazine release button 39 and (ii) to the front by the trigger over travel adjustment screw 33.

Referring to FIGS. 12-16, partial diagrams of a magazine release mechanism of the pistol 100 are shown. The pistol 100 may include the trigger pin 31, the trigger return plunger 32, the trigger over travel adjustment screw 33, the trigger return adjustment screw 34, the trigger return spring 36, the trigger return lever 37, the right-hand magazine release button 38 having an angled surface 38*a*, the hole 38*b*, and an eccentric portion (or assembly) 38*c*, the left-hand magazine release button 39 having an angled surface 39*a*, a flat portion 39*b* and a flat 39*c*, a magazine tube (or assembly) 45 having a flange (or assembly) 45*a* and a retention notch 45*b*, a magazine follower (or assembly) 46, a magazine base (or assembly) 47 having an inner floor (or assembly) 47*a*, a disassembly notch 47*b* and multiple slots 47*c*, a magazine spring (or assembly) 48 having a rear loop 48*a* and a front loop 48*b*.

The magazine release mechanism is generally located at the lower rear of a trigger guard. The magazine release mechanism may include two pieces (e.g., the left-hand magazine release button 39 and the right-hand magazine release button 38) in two lateral holes on opposite sides in the frame 2 forming a common hole through the frame 2. The left-hand magazine release button 39 generally includes the flat 39*c* and the flat portion 39*b*. The flat portion 39*b* may pivotally engage a notch 45*b* in the magazine tube 45. The flat 39*c* generally contacts the trigger return lever 37 so that the left-hand magazine release button 39 may be rotated counter clockwise in the corresponding lateral hole, as viewed from the right of the pistol 100, by the trigger return lever 37 to engage the notch 45*b* in the magazine tube 45. The trigger return lever 37 may also prevent the left-hand magazine release button 39 from drifting out of the corresponding lateral hole in the frame 2 on the left side of the pistol 100.

The left-hand magazine release button 39 may have an angled surface 39*a* that contacts a corresponding angled surface 38*a* on the right-hand magazine release button 38. A cylindrical projection 39*d* on the end of the left-hand magazine release button 39 generally goes into the hole 38*b* in the right-hand magazine release button 38. The right-hand magazine release button 38 may have an eccentric portion 38*c* that fits into an eccentric recess in the frame 2 to prevent rotation of the right-hand magazine release button 38.

Pushing inboard on the magazine release buttons 38 and/or 39 generally causes the angled surfaces 38*a* and 39*a* to engage each other. The engagement may cause a rotation of the left-hand magazine release button 39 clockwise, as viewed from the right of the pistol 100. The rotation generally disengages the flat portion 39*b* of the left-hand magazine release button 39 from the notch 45*b* of the magazine tube 45. Releasing the inboard pressure on both magazine release buttons 38 and 39 generally allows the trigger return lever 37 to rotate the left-hand magazine release button 39 counter clockwise, as viewed from the right of the pistol 100. Releasing the inboard pressure also allows the mating angled surfaces 38*a* and 39*a* to force each release button 38 and 39 outboard in the lateral holes.

Figure 11:
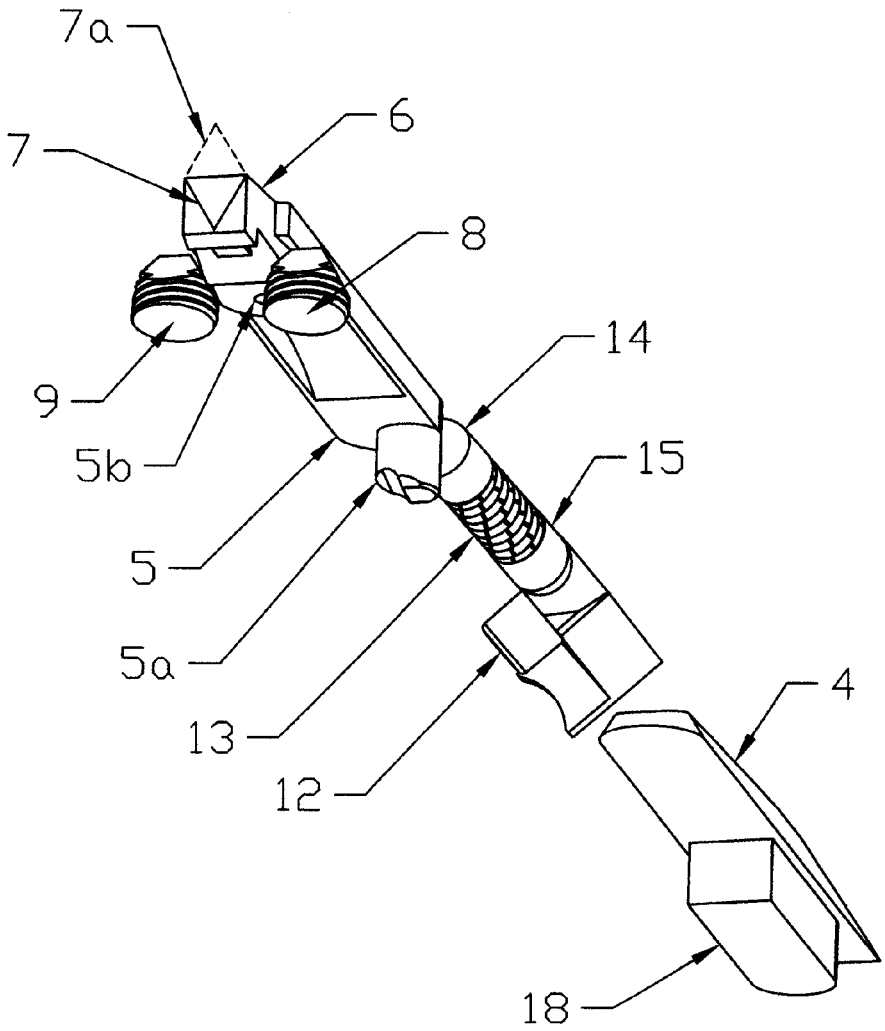
FIG. 11 is a partial diagram of the sight mechanism.
Figure 12:
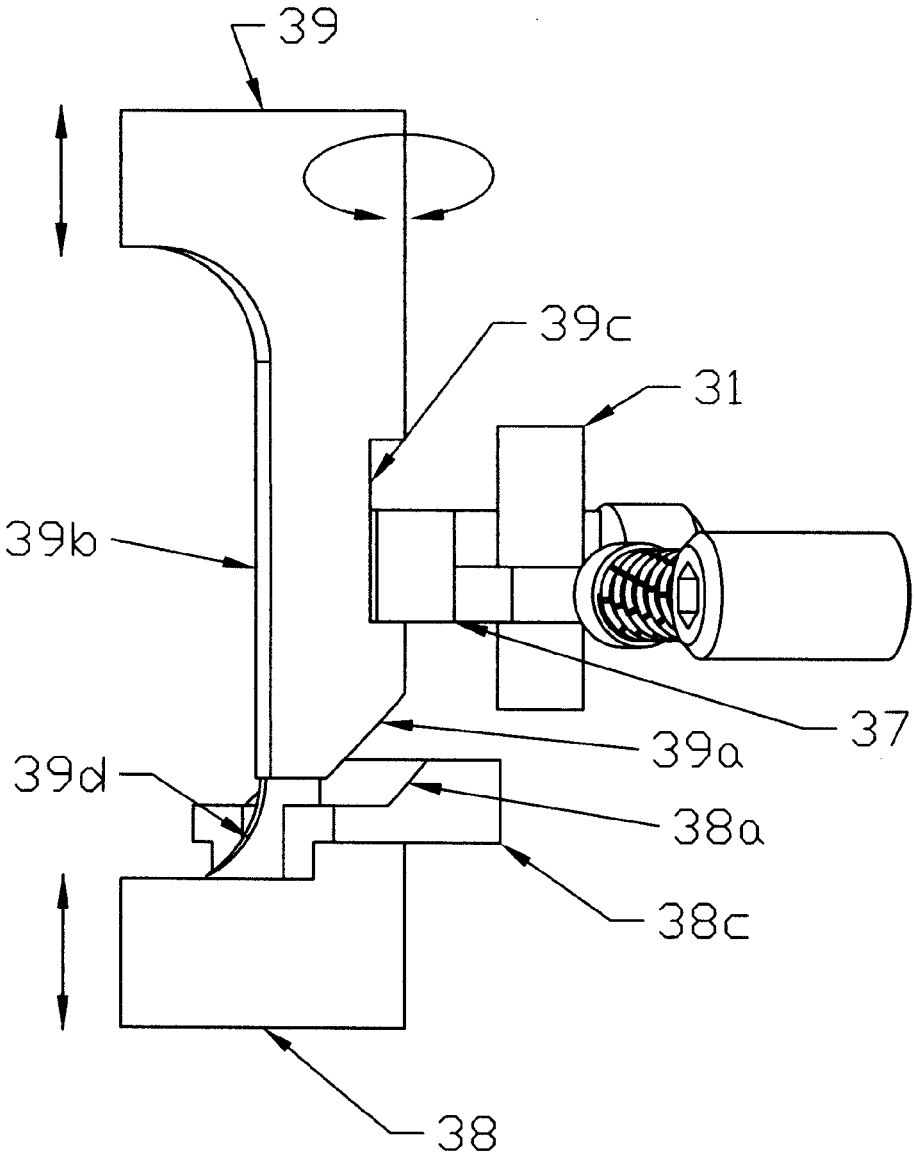
FIG. 12 is a top-view diagram of a magazine release mechanism.
Figure 13:
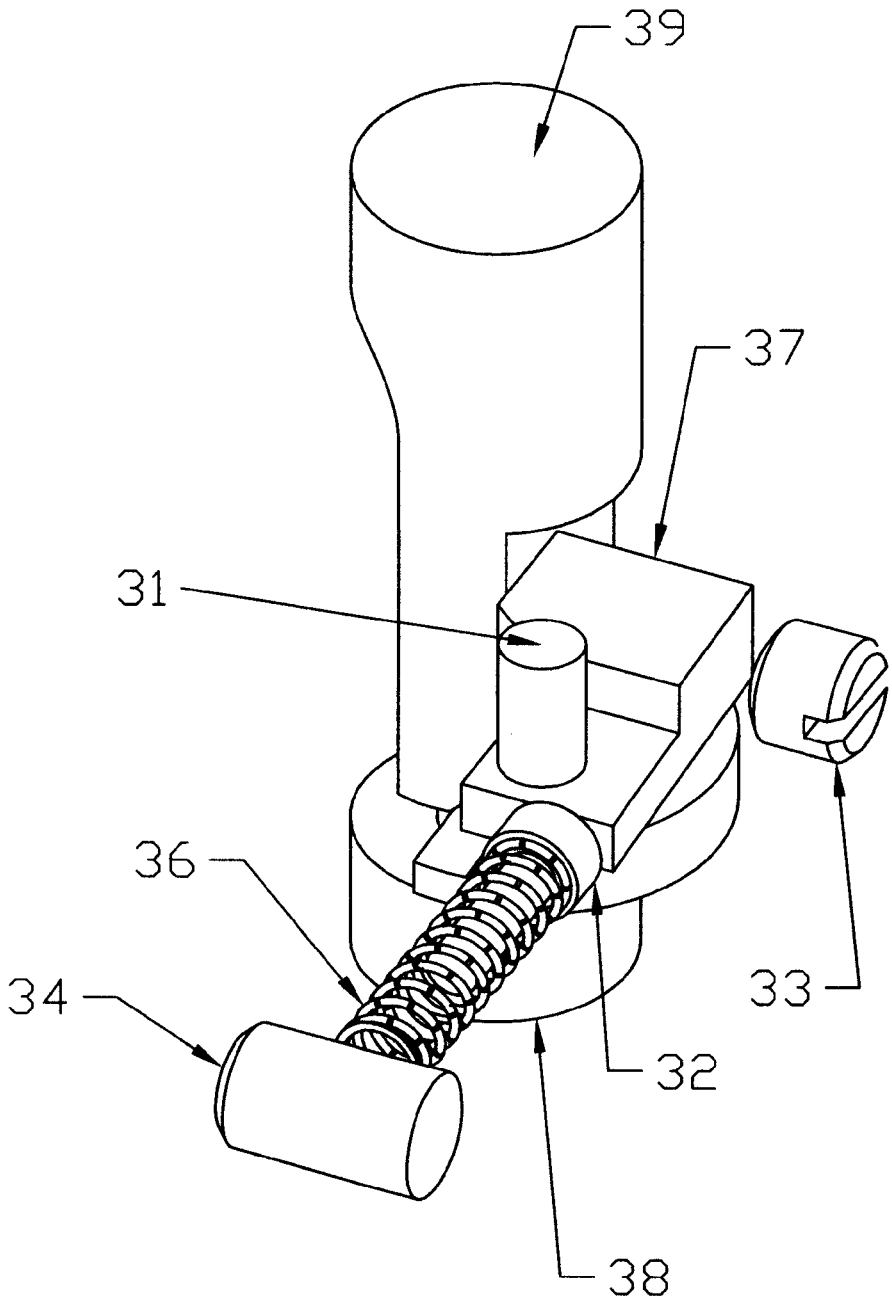
FIG. 13 is a perspective-view diagram of the magazine release mechanism.
Figure 14:
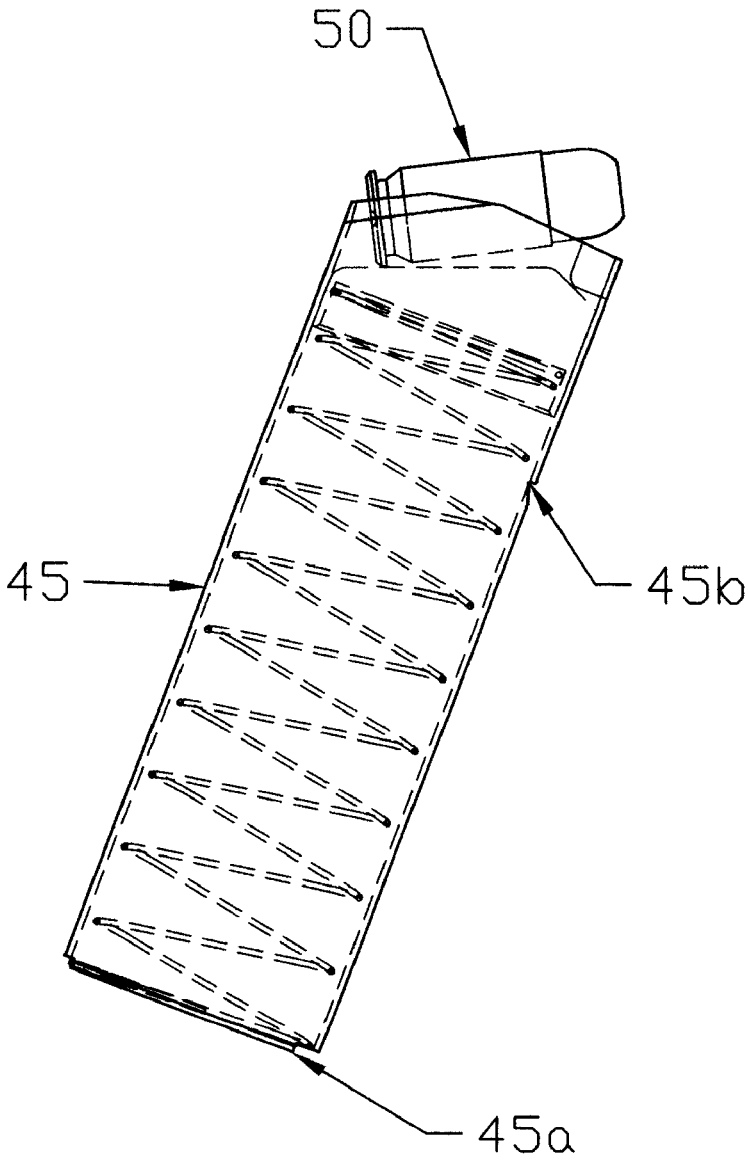
FIG. 14 is a see-through diagram of a magazine.
Figure 15:
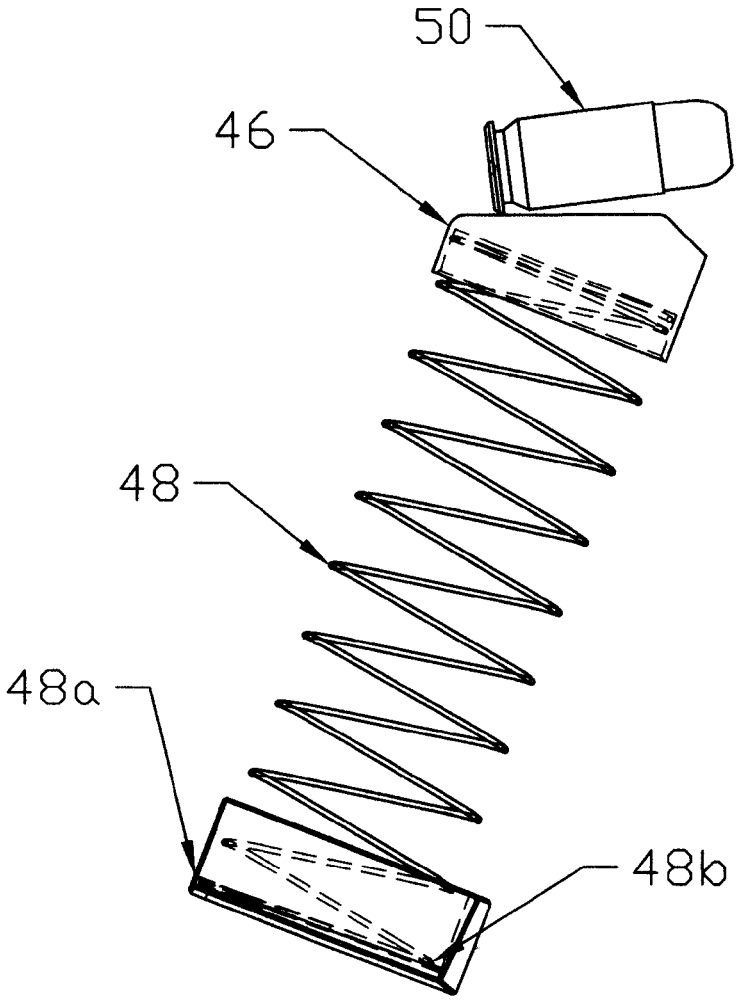
FIG. 15 is a partial diagram of the magazine.
Figure 16:
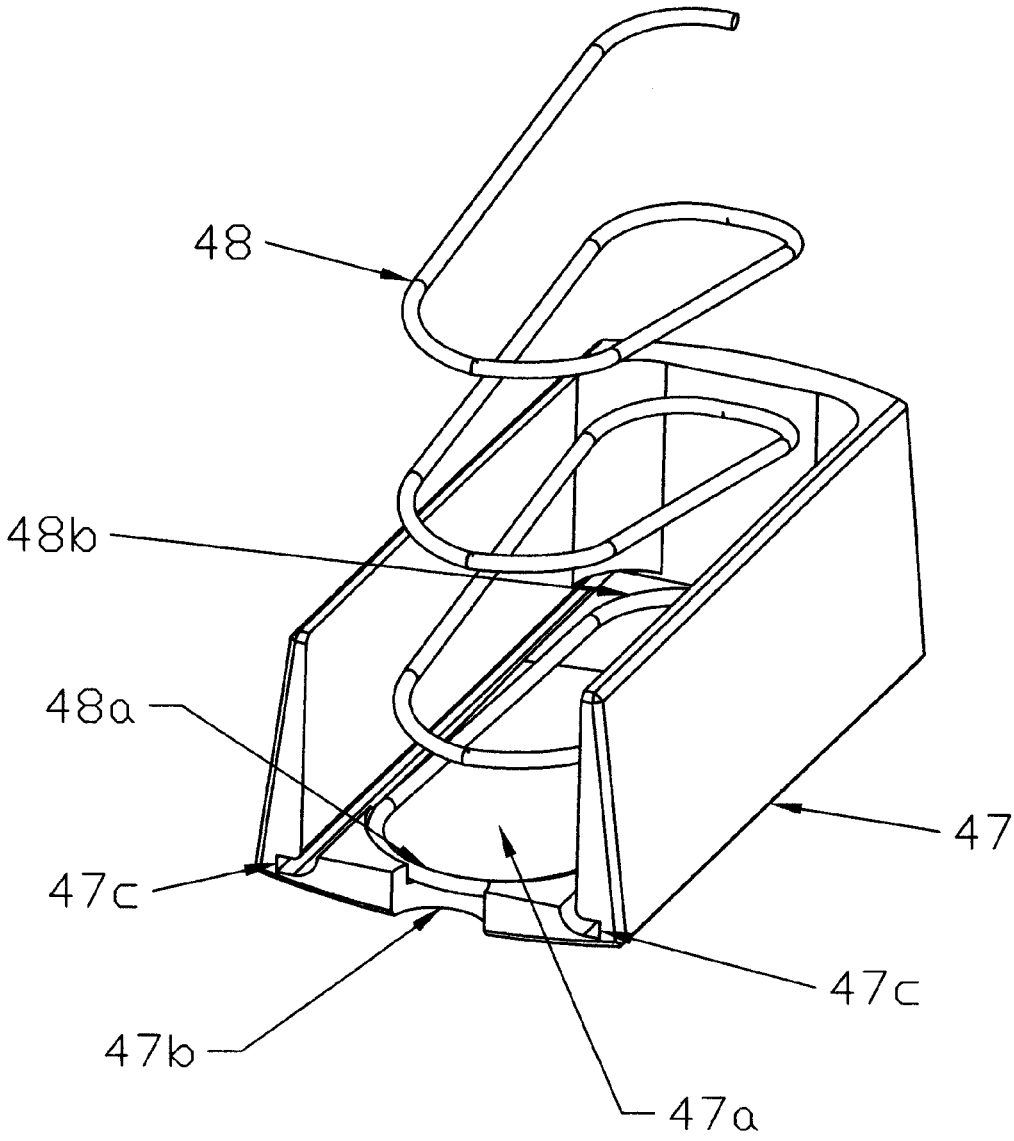
FIG. 16 is a partial diagram of the magazine.
Figure 17:
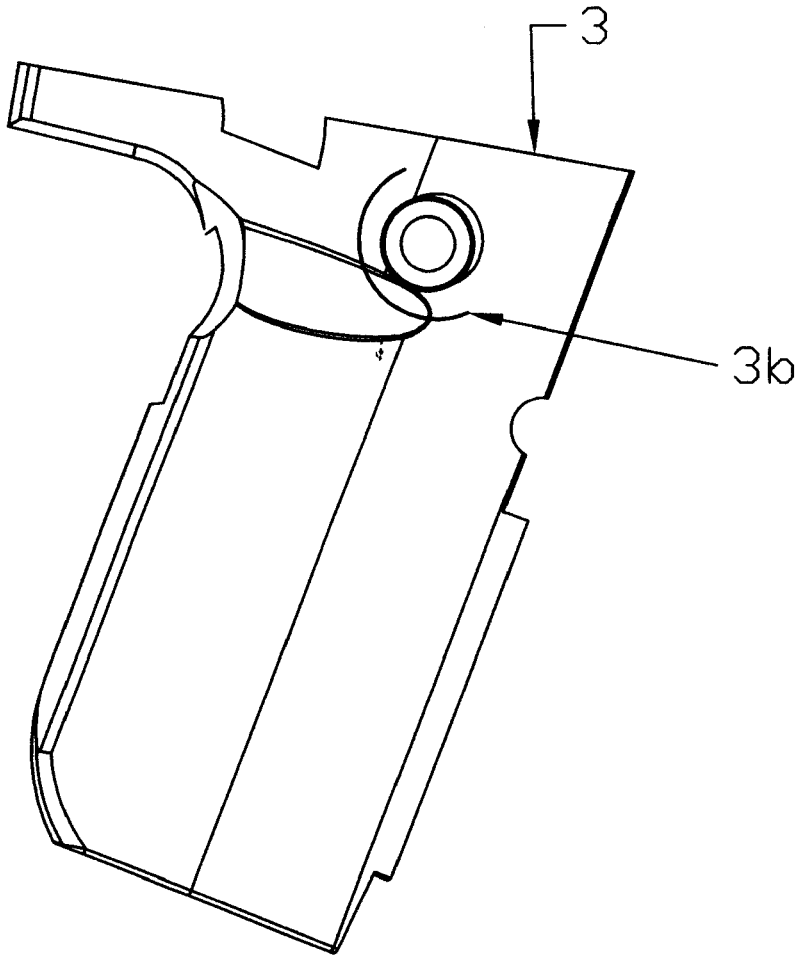
FIG. 17 is a side-view diagram of a grip.

Referring to FIGS. 5 and 11, partial diagrams of a sight mechanism portion of the pistol 100 are shown. The pistol 100 may include the front sight 4, the rear sight base 5 having a post (or assembly) 5*a* and a cylindrical projection (or assembly) 5*b*, the rear sight tail 6, the rear sight insert 7, the adjustment screws 8 and 9, the extractor 12, the extractor spring 13, the rear sight plunger 14, the extractor plunger 15, the control lug 16*b*, the barrel bushing 17, the recoil buffer 18 and the slide stop pin 22*b*.

The sight mechanism generally include the front sight 4 and the rear sight tail 6. The front sight 4 may be a fixed front sight. The front sight 4 may have a generally elongated pyramidal shape with a peak at the 12 o'clock position. The rear sight tail 6 may be a windage adjustable and an elevation adjustable sight assembly mounted on the slide 1. The rear sight insert 7 may appear as a triangle with a point at each of (i) the 3 o'clock position, (ii) the 6 o'clock position and (iii) the 9 o'clock position. The sight 4 and the sight insert 7 may be sized to appear similar in size (e.g., width and height) when viewed at arms length. Alignment of the pistol 100 is generally indicated when the two triangles appear as a single diamond 7*a*.

The front sight 4 generally appears as a triangular cross section piece set in a dovetail slot cut longitudinally into the top of the slide 1. The front sight 4 is retained in the dovetail slot by a projection on the barrel bushing 17 when the barrel bushing 17 is rotated into place on the slide 1.

The rear sight assembly generally includes the rear sight insert 7 in the rear sight tail 6, the rear sight base 5, the adjustment screws 8 and 9 and the rear sight plunger 14. The rear sight base 5 may be set in a longitudinal slot in the slide 1 with the cylindrical projection 5*b* on the rear sight base 5 in a vertical hole at the front end of the rear sight slot. The spring loaded rear sight plunger 14 (which shares the extractor spring 13 with the extractor plunger 15) generally puts pressure on the rear sight base forcing the rear sight base 5 down (e.g., rotating counter clockwise viewed from the right) about the cylindrical projection 5*b*. The extractor 12 may attach the rear sight assembly to the slide 1.

The rear sight tail 6 with the rear sight insert 7 generally sits in the same slot as the rear sight base 5 and pivots on a cylindrical pin 5*b* extending down from the rear of the rear sight base 5. The pin 5*b*, which is roughly vertical in normal use, generally allows the rear sight tail 6 to pivot left and right (e.g., yaw) as view from the top rear of the pistol 100. The two adjustment screws 9 and 8 may be disposed in holes in the bottom of the slide 1. The holes may be perpendicular to the bottom of the slide 1 and parallel to each other. The screws 9 and 8 generally have angled flats that contact the bottom of the rear sight tail 6 and move the rear sight tail 6 left/right and up/down as the screws 9 and 8 are turned up and down in the holes. The flats may provide incremental adjustment clicks at angles relative to the screw's axis along with the sight tail 6 and base lever length to provide similar windage increments and elevation increments. A spring pressure acting opposite to the screws 9 and 8 generally prevent loss of the settings. Turning both screws 9 and 8 in the same direction (e.g., clockwise or counter clockwise) may change the elevation setting (e.g., bullet vertical impact). Turning the screws 9 and 8 opposite each other may move the rear sight tail 6 left/right thereby shifting the bullet impact left/right.

Referring to FIGS. 17-21, partial diagrams of the grip 3 are shown. The grip 3 may include two circular ends (e.g., bosses) 3*a*, two cuts 3*b*, two shallow lateral depressions 3*c*, two under cuts 3*d* and a recessed grove 3*e* on the left side. The bosses 3*a*, one on each side of the grip 3, may engage the holes 2*b* on either side of the frame 2.

Normally the two position slide stop 22 and the two position safety levers 42 and 44 may be maintained in the user selected position by the double ended detent plunger spring detent plunger arrangement. A standard detent arrangement generally has the detent parts in a tube attached to the frame. An improvement arrangement of the pistol 100 generally has the one-piece safety detent spring 35 in the shape of an omega with each of the circular ends acting in a linear manner opposite the other. The one-piece safety detent spring 35 may be held in place laterally between the grip 3 and the frame 2. The one-piece safety detent spring 35 may be held vertically by the recessed grove 3*e* in the grip 3 that holds each circular end of the one-piece safety detent spring 35 in position in contact with the left-hand safety lever 44 and the slide stop 22.

Referring again to FIGS. 14-16, the magazine assembly 45-58 generally includes four parts. The magazine assembly 45-48 may be retained in the pistol 100 by the magazine release mechanism, as described above. A difference from common magazine designs may be that the magazine spring 48 generally retains the magazine base 47 directly. The magazine base 47 may slide onto the magazine tube 45 from front to back and is retained vertically on the flange 45*a* at the bottom of the magazine tube 45. The magazine base inner floor 47*a* may be angled such that the magazine spring 48 sits lower (in relation to the magazine tube 45) at the rear of the magazine tube 45. The rear loop 48*a* of the bottom magazine spring coil 48 generally drops below the bottom of the magazine tube 45. At the same time, the front loop 48*b* of the bottom magazine spring coil 48 generally stays up against an inner surface of the magazine tube 45.

Figure 4:
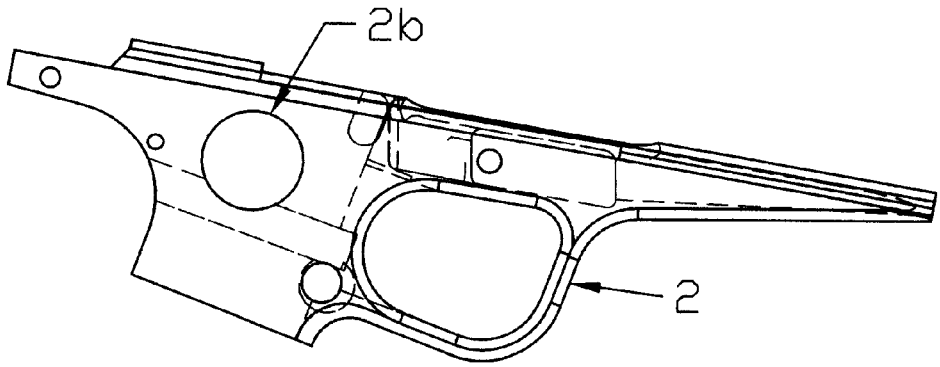
FIG. 4 is a side-view diagram of the frame.
Figure 18:
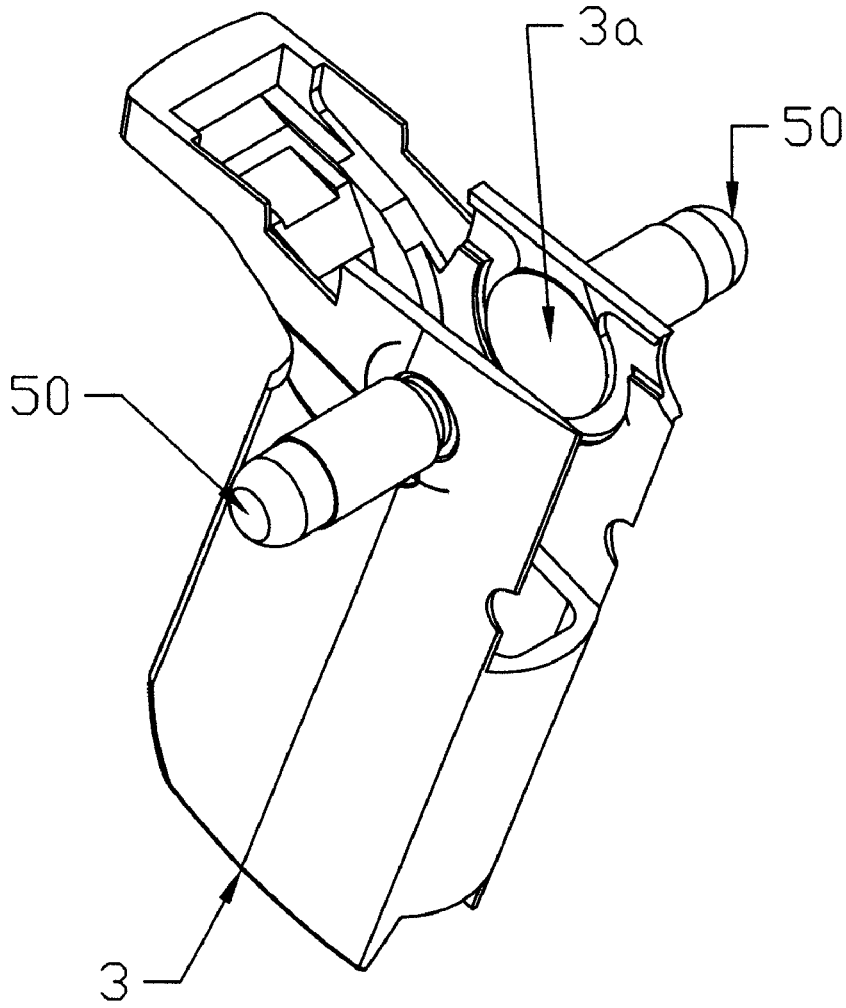
FIG. 18 is a perspective-view diagram of the grip.
Figure 19:
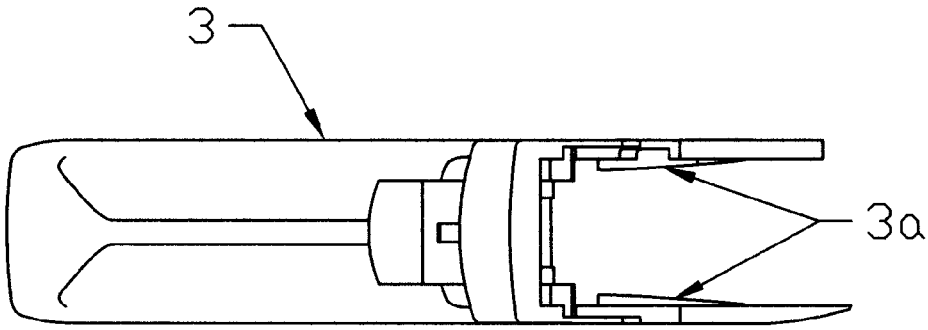
FIG. 19 is a top-view diagram of the grip.
Figure 20:
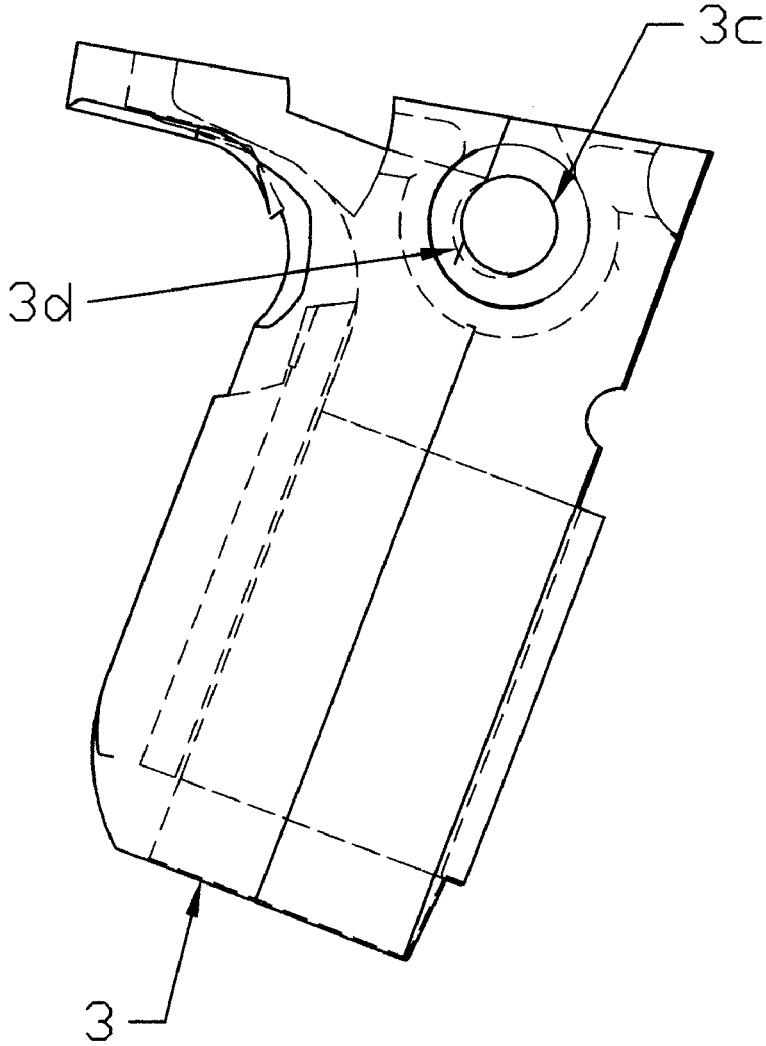
FIG. 20 is a partial side-view diagram of the grip.
Figure 21:
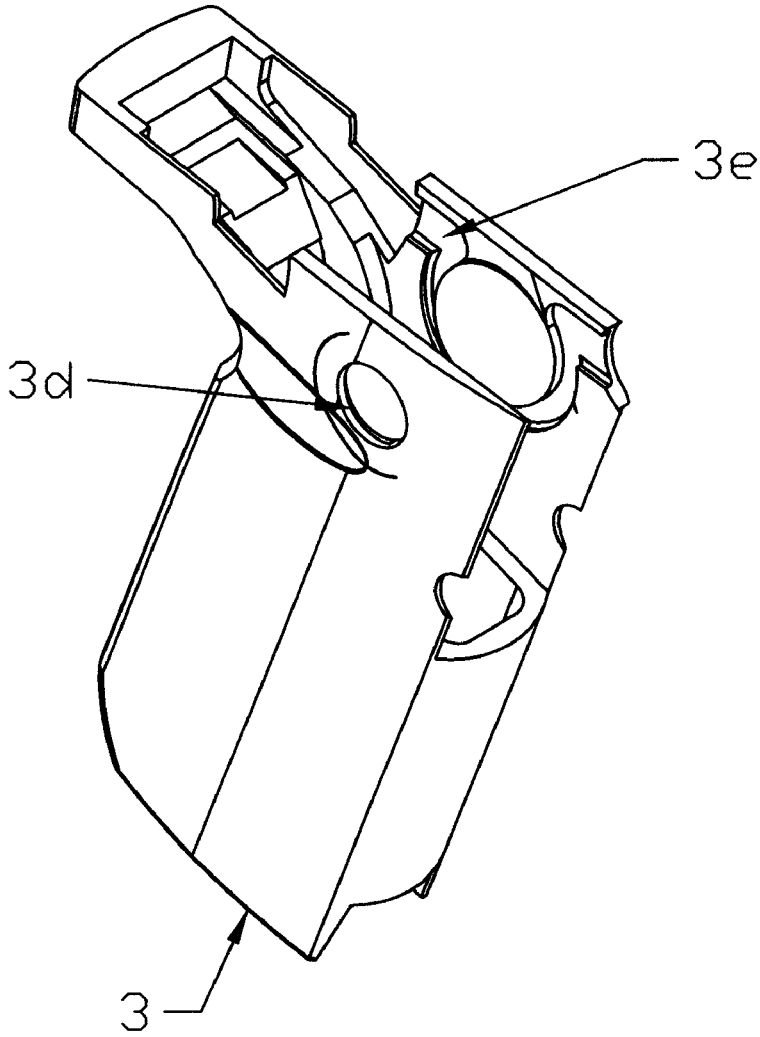
FIG. 21 is a partial perspective-view diagram of the grip.
Figure 22:
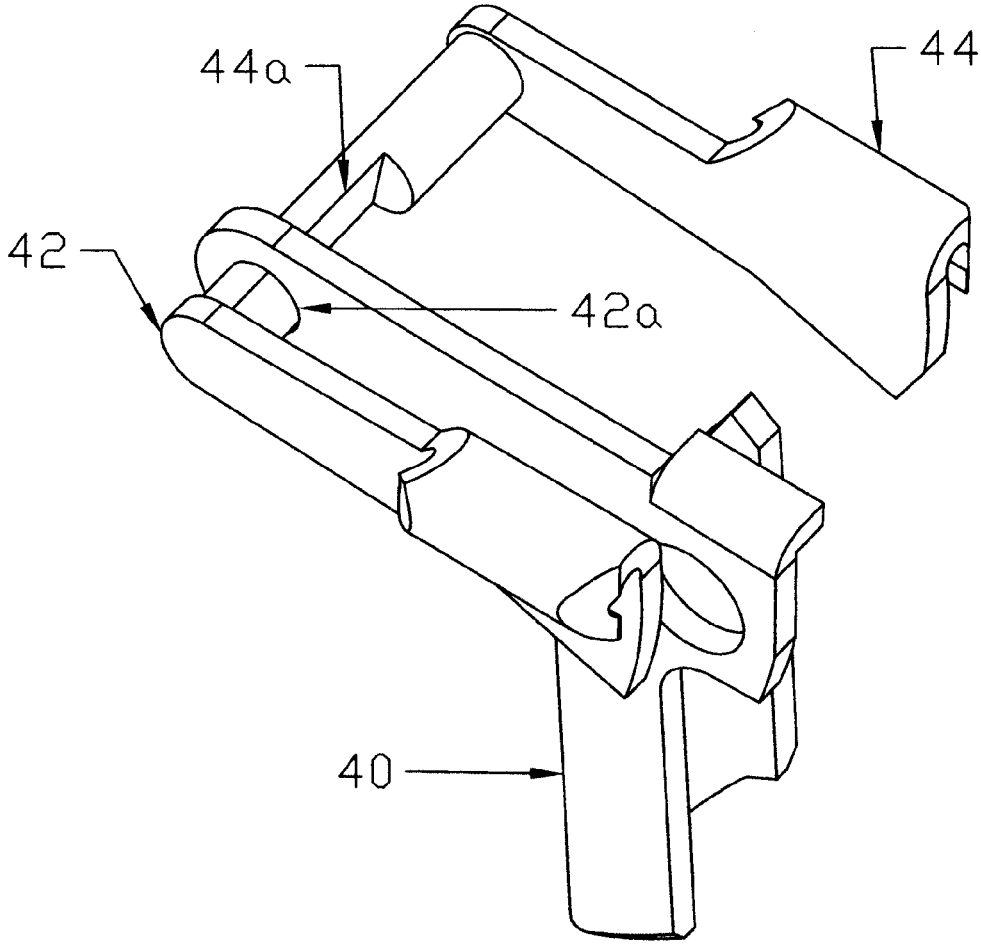
FIG. 22 is a partial diagram of the fire control mechanism.
Figure 23:
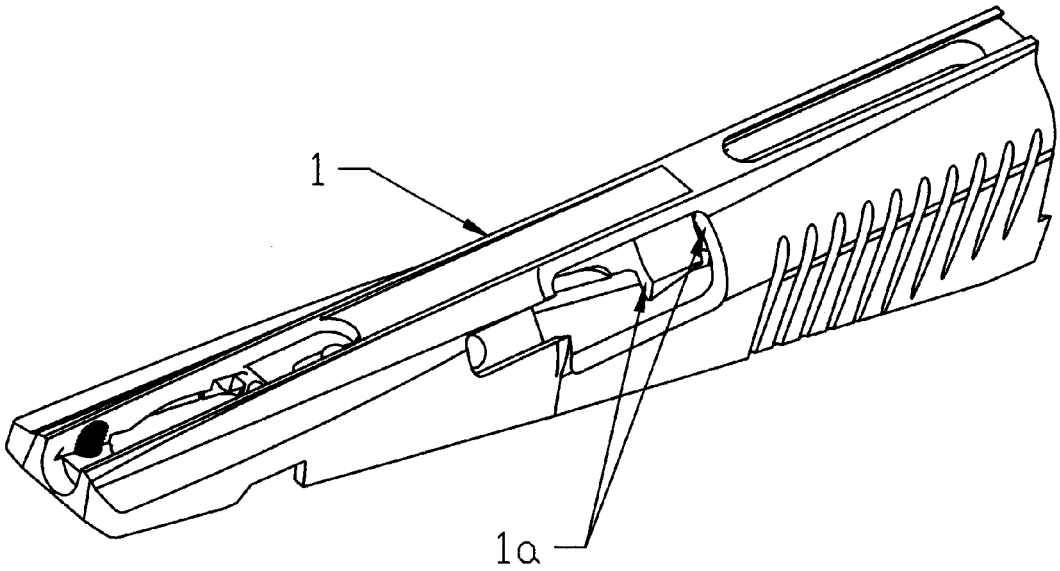
FIG. 23 is partial perspective-view diagram of a slide.

Referring to FIGS. 4 and 18, two bosses 3*a* of the grip 3 may fit into circular holes 2*b* in the frame 2. The bosses 3*a* may align with other net surfaces between the grip 3 and the frame holes 2*b* of the frame 2. The above arrangement generally holds the frame 2 and the grip 3 together and maintains the two parts in alignment with each other. The bottom rear portion of the bosses 3*a* are generally cut 3*b* through the grip 3 to allow the bosses 3*a* to flex outward when the angled inner surface of the bosses 3*a* contacts the frame 2 as the grip 3 is pushed onto the frame 2. The bosses 3*a* may snap into the respective holes 2*b* in the frame 2. The bosses 3*a* generally remain snapped into the holes 2*b* until being flexed outward by hooking an extractor rim of a cartridge case 50 (for which the pistol 100 is chambered) into each of the holes 3*c* centered on the outboard side of the bosses 3*a*. The extractor rims generally bend the bosses 3*a* out of the holes 2*b* in the frame 2. The holes 3*c* on either side of the grip 3 may have an undercut 3*d* at the bottom rear to engage the extractor rim. The grip 3 may then be pulled down and back off of the frame 2 as the bosses 3*a* are forced clear of the mating holes 2*b* in the frame 2.

Some embodiments of the present invention generally include a relocation of the barrel bore axis "lower" in relation to the user's thumb and index finger web. For example, the barrel bore axis 104 may be approximately ⅛ inches above the web of the shooter's hand. The lowering generally improves handling and reduced "overburden" recoil that may be caused by a relationship between the muzzle and the web of the shooter's hand. Reducing the overburden may reduce the implementation of expensive and power robbing compensators. Some embodiments may also provide sear-less operation providing ease of manufacture, simplified trigger pull adjustment, smooth operation, and short trigger travel. The "aligned triangle" sight design may be used for aiming. The sight mechanism may be click-adjustable for windage and elevation by means of two locking, hidden screws. The aligned-triangle sight may be implemented with field replaceable inserts. The sight mechanism may also provide rapid target acquisition, precision alignment, unobstructed target view, is generally low profile and snag-less. Some embodiments may include an improved ambidextrous magazine release that enables the shooter to release the magazine from either side using either hand. Furthermore, the pistol 100 may be completely field strippable without the use of special tools. The pistol 100 may provide a short recoil operated locked breach, a bushed barrel, an out of battery safety, an ambidextrous manual safety, and may be completely compression spring operated.

While the invention has been particularly shown and described with reference to the preferred embodiments thereof, it will be understood by those skilled in the art that various changes in form and details may be made without departing from the scope of the invention.

The invention claimed is:

1. An apparatus comprising:

a frame;

a slide assembly slidably mounted to said frame along a sliding plane; and a barrel disposed in said slide assembly, said barrel having a bore shaped to accept an ammunition round, said bore defining a bore axis intersecting said sliding plane such that when said ammunition round is fired said slide assembly recoils both backward and upward relative to said frame; and at least one locking surface formed in said slide assembly; and at least one locking lug disposed on said barrel, said locking lug alternatively engaging and disengaging said locking surface to respectively lock and unlock said barrel from said slide in response to an angular orientation of said barrel about said bore axis.

2. The apparatus according to claim 1, further comprising:

a cam track formed in said frame; and a control lug disposed on said barrel, said control lug engaging said cam track to control said angular orientation of said barrel about the bore axis.

3. The apparatus according to claim 2, wherein (i) said locking lug and said locking surface normally lock said barrel to said slide assembly and (ii) said control lug and said cam track disengage said locking lug from said locking surfaces during said recoil of said slide assembly.

4. The apparatus according to claim 1, further comprising a grip attachable to said frame, said grip comprising a plurality of bosses flexibly mounted in a cavity of said grip, said bosses engaging a corresponding plurality of first holes in said frame while said grip is attached to said frame.

5. The apparatus according to claim 4, wherein said grip further comprises a plurality of second holes aligned with said bosses, said second holes being sized to accept said ammunition round, and each of said bosses comprising an undercut sized to accept a rim of said ammunition round to disengage said bosses from said first holes.

6. The apparatus according to claim 1, further comprising a front sight mounted to said slide, said front sight having a shape that appears as a first triangle while viewed parallel to said bore axis.

7. The apparatus according to claim 1, further comprising a magazine release mechanism attached to said frame, said magazine release mechanism comprising a first release button and a second release button both protruding out of said frame and disposed on opposing lateral sides of said frame.

8. The apparatus according to claim 6, further comprising a rear sight assembly mounted to said slide, said rear sight assembly having an insert that appears as a second triangle while viewed parallel to said bore axis, said front sight and said insert being aligned with each other such that said first triangle and said second triangle appear as a diamond while viewed parallel to said bore axis.

9. The apparatus according to claim 7, further comprising a magazine (i) engaging said magazine release mechanism while neither of said first release button and said second release button are pressed and (ii) disengaging said magazine release mechanism while at least one of said first release button and said second release button is pressed.

10. The apparatus according to claim 1, wherein said apparatus comprises a pistol.

11. The apparatus according to claim 1, wherein an angle between said sliding plane and said bore axis ranges from approximately 5 degrees to approximately 15 degrees.

12. The apparatus according to claim 1, wherein said barrel recoils a dwell distance while locked to said slide assembly after said ammunition round is fired.

13. The apparatus according to claim 12, wherein said barrel unlocks from said slide assembly upon reaching said dwell distance.

14. The apparatus according to claim 1, further comprising a barrel bushing attached to said slide assembly at a muzzle end of said apparatus.

15. The apparatus according to claim 14, further comprising a guide rod attached to said frame by a pin below said barrel.

16. The apparatus according to claim 15, further comprising a spring disposed around said guide rod and between said frame and said barrel bushing to bias said slide assembly to a battery position.

17. The apparatus according to claim 16, further comprising a guide rod ball disposed around said guide rod and biased against said barrel bushing by said spring.

18. The apparatus according to claim 1, wherein said bore axis is located above said sliding plane at a muzzle end of said apparatus.

19. The apparatus according to claim 1, further comprising a trigger, wherein said bore axis intersects said sliding plane behind said trigger.

20. The apparatus according to claim 1, wherein said bore axis is located below said sliding plane at a tail end of said apparatus.

* * * * *